United States Patent [19]

Bowles et al.

[11] 4,010,766

[45] Mar. 8, 1977

[54] CHANGE DISPENSING APPARATUS

[75] Inventors: Ralph F. Bowles, Ithaca; Arthur Hartvig, Spencer, both of N.Y.

[73] Assignee: NCR Corporation, Dayton, Ohio

[22] Filed: Dec. 8, 1975

[21] Appl. No.: 638,877

[52] U.S. Cl. ..... 133/4 A
[51] Int. Cl.[2] ..... G07D 1/00
[58] Field of Search ..... 133/1 R, 2, 4 R, 4 A, 133/5

[56] References Cited

UNITED STATES PATENTS 3,131,702 5/1964 Buchholz et al. ..... 133/4 R

*Primary Examiner*—Allen N. Knowles
*Attorney, Agent, or Firm*—J. T. Cavender; Wilbert Hawk, Jr.; Richard W. Lavin

[57] ABSTRACT

There is disclosed a change dispensing apparatus which includes a coin receptacle forming a portion of the top surface of the dispensing apparatus. The dispensing apparatus also includes an insertable coin magazine comprising a plurality of coin channels each extending in a vertical direction and having a discharge end position around the rim of the coin receptacle. A cover member hinged to the top of the apparatus supports a plurality of coin ejector members, the cover member being moved to a closed position over the coin magazine and adjacent the coin receptacle where the ejector members will be positioned to engage the top coin in each coin channel for ejecting the coin into the coin receptacle when operated. Means are provided to hold the coins in each of the coin channels and for urging the coins into the topmost position in the coin channel for dispensing into the coin receptacle upon operation of the ejector member.

20 Claims, 6 Drawing Figures

CHANGE DISPENSING APPARATUS

BACKGROUND OF THE INVENTION

Prior change dispensing apparatuses have been of the type in which coins are ejected from the bottom of coin channels into a coin receptacle which of necessity is positioned below the discharge area of the coin channels since the coins are normally delivered thereto by means of gravity. With the development of modern checkout counters, the change dispensing apparatus has been required to be mounted within the counter together with other mechanisms associated with the checkout operation. When the dispensing apparatus is mounted in this position, the coins are required to be delivered to the top of the checkout counter in order for the customer to collect the change. Therefore, the coin receptacle is required to be mounted above the change dispensing mechanism. Prior arrangements designed to solve this problem have resulted in transporting dispensed coins from the discharge portion of the dispensing mechanism to the coin receptacle by means of a conveyor belt system. This arrangement is shown in U.S. Pat. No. 3,175,563 issued to R. C. Simmerman et al. and assigned to the assignee of the present application. While the arrangement shown in such patent operates satisfactorily, the cost of the installation is high since the transporting mechanism is required in addition to the dispensing mechanism. Another type of dispensing mechanism is shown in U.S. Pat. No. 3,131,702, which discloses a change dispenser wherein the coins are ejected from the top of a coin channel and are delivered by gravity into a coin receptacle located at the bottom of the dispensing apparatus. It is therefore an object of the present invention to provide a change dispensing apparatus in which coins are deliverd into a receptacle positioned on top of the dispensing apparatus. It is a further object of this invention to provide a change dispensing apparatus in which the coin ejector mechanisms are easily accessible for repair or replacement. It is another object of this invention to provide a low cost change dispensing apparatus which can be readily mounted within a checkout counter or on top of the counter if desired. It is an additional object of this invention to provide a coin magazine construction for use in a change dispenser in which the coins are inserted into the top of the magazine and effectively held in the magazine so as to allow the magazine to be stored in a horizontal position.

SUMMARY OF THE INVENTION

In order to carry out these objects, there is provided a change dispensing apparatus which includes an open ended housing member within which is mounted a coin magazine consisting of a plurality of coin channels orientated in a vertical direction, each coin channel having a discharge end located at the top of the magazine and positioned around the rim of a coin receptacle mounted at the top of the housing. A cover member hinged to the top of the housing is positioned over the top of the coin channels, the cover member supporting a plurality of ejector mechanism each of which is associated with one of the coin channels to eject the uppermost coin of the coin channel into the coin receptacle when operated. Means are provided to hold the coins in the coin channel and to allow coins to be inserted into the coin channel from the top of the magazine. Other means are provided to urge the coins in the coin channel in a upward direction. The foregoing and other objects, features and advantages of the invention will become apparent from the following preferred embodiment illustrated in the accompanying drawings.

DESCRIPTION OF THE PREFERRED EMBODIMENT

Figure 1:
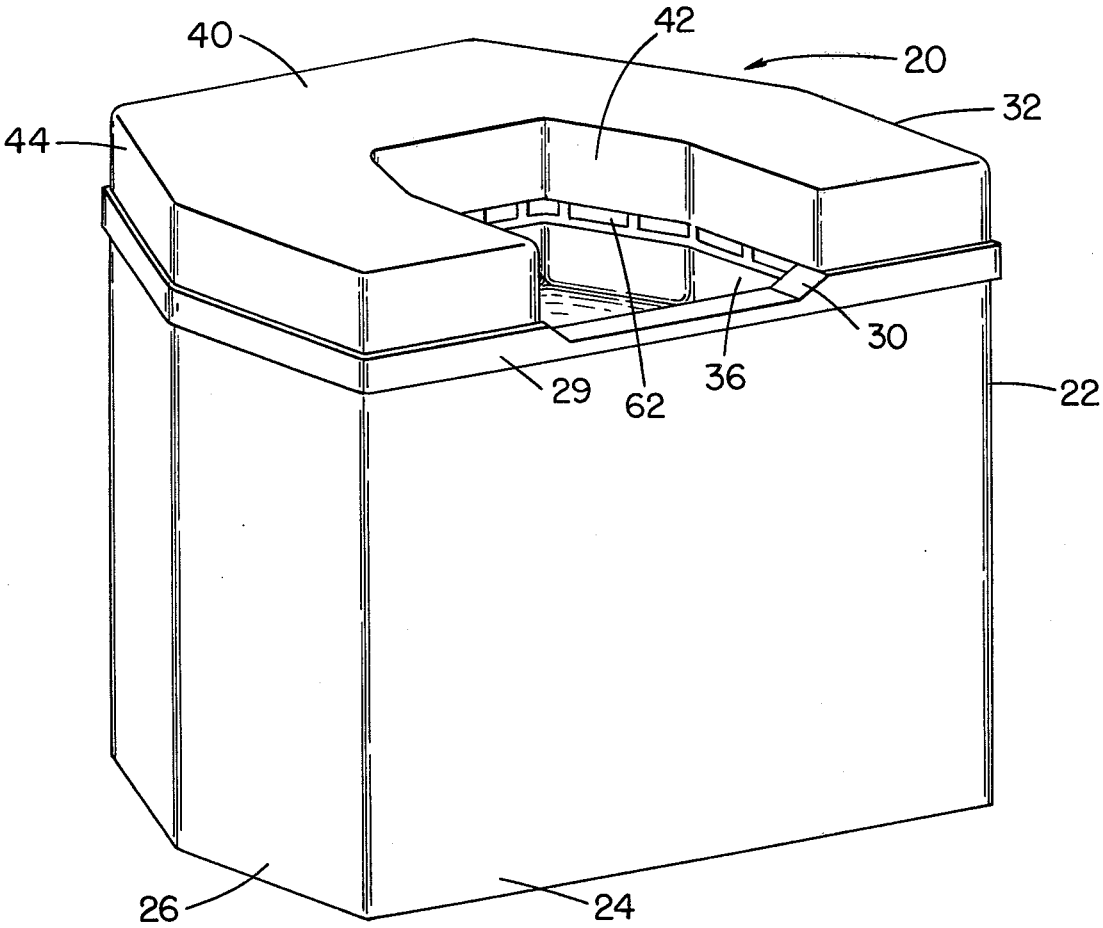
FIG. 1 is an oblique view of the dispensing apparatus constructed in accordance with the present invention showing the cover assembly in a closed position on the housing surrounding the coin receptacle.

Referring to FIG. 1 of the drawing, there is shown an oblique view of the novel change dispensing apparatus indicated generally by the reference character 20 comprising an open topped housing member 22 preferably having a continuous outer wall member including front 24 and side wall portions 26. In addition, the continuous wall member includes a rear wall portion 28 (FIG. 3). The top of the wall member terminates in a rib portion 29 having a top supporting surface 30. Hinged to the supporting surface 30 adjacent the front wall portion 24 of the housing member 22 by means of hinge members 34 (FIG. 2) is a U-shaped cover assembly 32 adapted for movement between an open and closed position (FIG. 1) with respect to the top of the housing 22.

In accordance with the invention, there is positioned within the housing 22, slightly below the supporting surface 30 of the rib portion 29 and adjacent the front wall portion 24, a coin receptacle 36 (FIGS. 1–3 inclusive for receiving coins as a result of the operation of the dispensing apparatus. As shown in FIG. 1, the rib portion 29 is partially recessed adjacent the front wall portion 24 of the housing member 22 to facilitate the retrieval of the coins deposited in the coin receptacle 36. As shown more clearly in FIG. 3, the coin receptacle 36 employed in the present embodiment is formed as part of a vertically extending inner wall portion 38 of the housing member 22, the forward portion of the receptacle being secured to the front wall portion 24 of the member 22 by any suitable means. It is obvious that the coin receptacle 36 can be separately attached to the wall portion 38 if that is desired. The housing member 22 and the cover assembly 32 of the present embodiment together with all of their structural elements are preferably molded of any well known high impact plastic material, such as styrene, in order to reduce the cost of the dispensing apparatus to a minimum. If the structural framework is made of metal, the parts thereof may be assembled by any well known acceptable method such as screws or welding. As shown in FIG. 1, the cover assembly 3 includes a top surface portion 40, an inner side wall portion 42 and an outer side wall portion 44. When the cover assembly 32 is in a closed position (as illustrated in FIG. 1), the inner side wall portion 42 provides a generally vertical upper wall extension to the coin receptacle 36.

Figure 2:
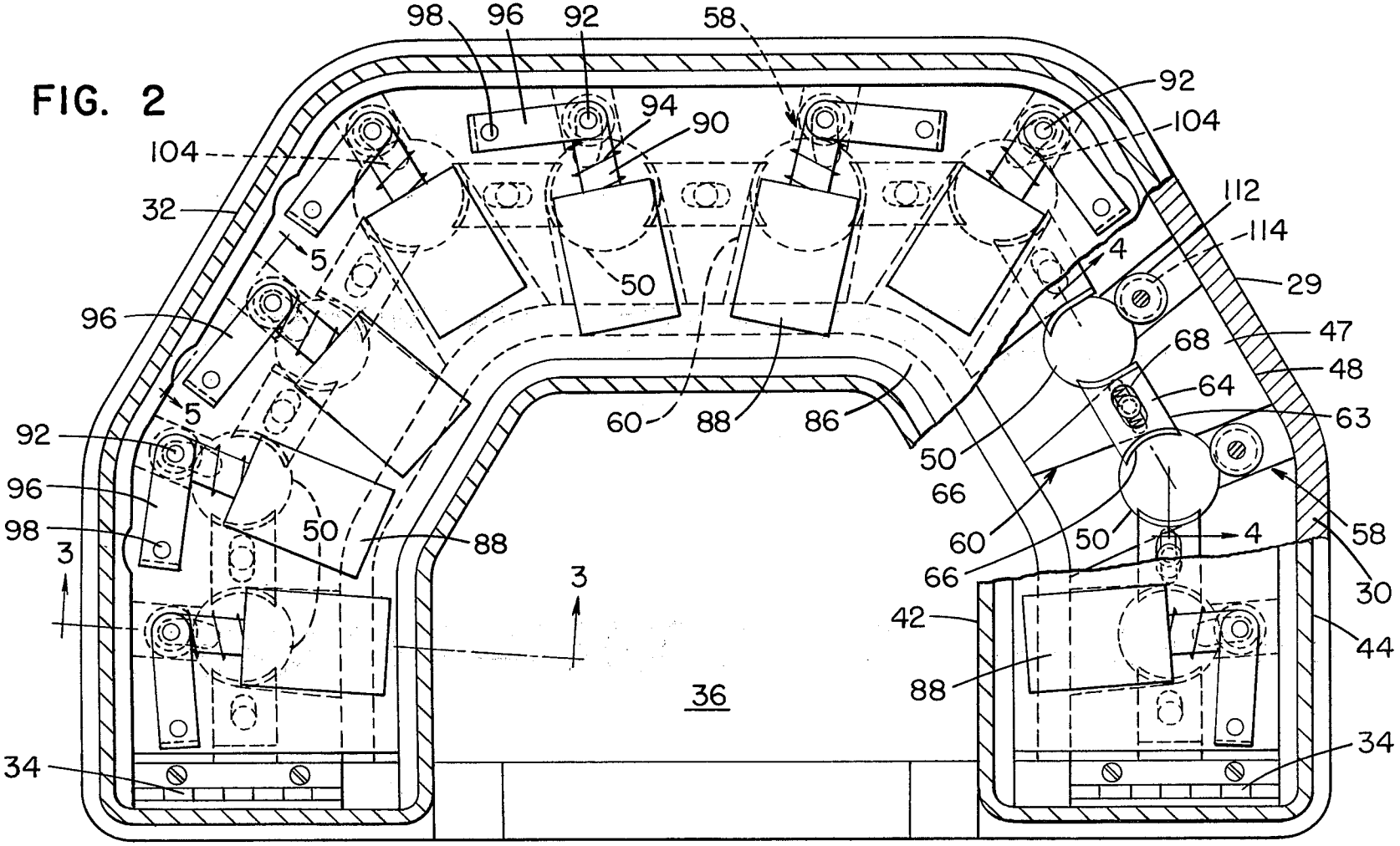
FIG. 2 is a top plan view of the dispensing apparatus in cross section taken through the cover assembly showing details of the ejecting mechanism with a portion removing showing further details of the top surface of the coin magazine.
Figure 3:
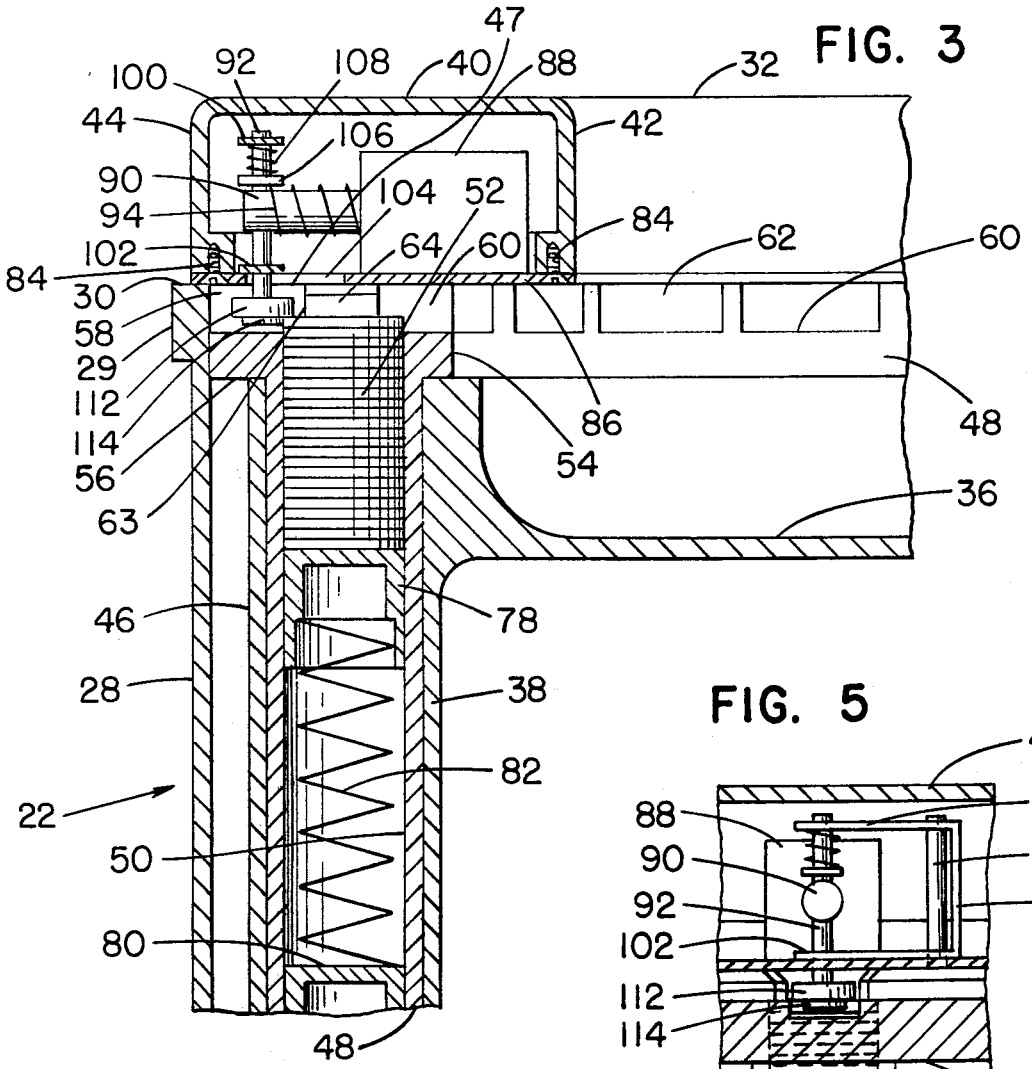
FIG. 3 is a partial sectional view taken on lines 3—3 of FIG. 2 showing details of the coin channel construction and the associated ejector mechanism.

As shown more clearly in FIG. 3, the housing member 22, in addition to the inner wall portion 38, includes a second inner wall portion 46 which together with the wall portion 38 forms a channel which supports therein a coin magazine generally indicated as 48 (see also FIG. 2). The coin magazine 48 is preferably fabricated as a unitary structure which may be insertable within the channel formed by the wall portions 38, 46 of the housing member 22. Both the coin magazine 48 and the wall portions 38, 46 are constructed in a generally U-shaped configuration, which is similar to the cover member 32, and which extends around the peripheral edge of the coin receptacle 36 (FIG. 2).

Formed as part of the coin magazine 48 are a plurality of coin receiving channels 50 (FIG. 2), each extending in a generally vertical direction (FIG. 3) when the magazine is mounted within the housing member 22. Each coin channel 50 will accommodate a stack of coins 52 of a specific denomination which is to be dispensed as change. As shown in FIG. 2, the present embodiment includes a coin magazine 48 having 10 coin channels 50 of varying denominations. It is obvious that any number of coin magazines 48 can be constructed, each with a different number of coin channels 50 to accommodate different denominations in accordance with business requirements. Each coin magazine 48 is easily mounted in the housing by lowering the magazine into the channel formed by the wall portions 38 and 46. The coin magazine 48 has a top surface portion 47 including a front 54 and rear 56 overhang portion which function to support the coin magazine on the wall portions 38 and 46 of the housing member 22 as shown in FIG. 3.

As clearly seen in FIGS. 2, formed in the top surface portion 47 of the coin magazine 48 and extending transversely between the inner and outer edges of the coin magazines at each coin channel 50 in a pair of chutes 58 and 60. The chute 58 extends between the coin channel 50 and the outer edge of the rib portion 29 of the housing member 22 while the chute 60 extends between the coin channel 50 and the front edge of the overhang portion 54 of the coin magazine 48 thereby forming an opening 62 (FIG. 3) in the overhang portion 54 adjacent each coin channel 50. As will be described more fully hereafter, the chute 58 accommodates a coin ejector for ejecting coins 52 from the coin channel 50 while the chute 60 allows the ejected coins to be deposited into the coin receptacle 36.

Figure 4:
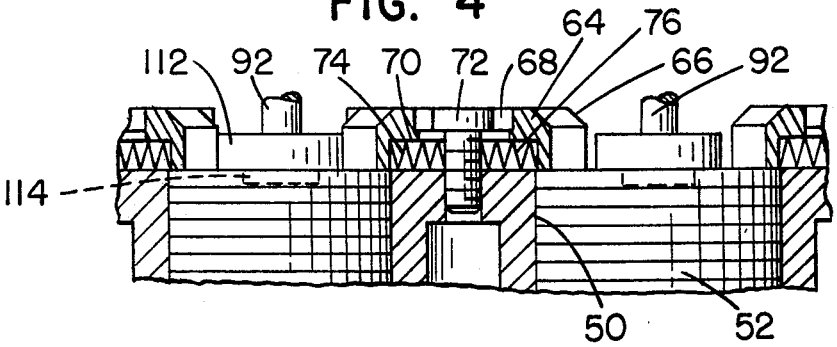
FIG. 4 is a partial sectional view taken on lines 4—4 of FIG. 2 showing details of the coin stop member.

In order to retain the coins 52 within the coin channel 50, there is slidably mounted within a slot 63 (FIGS. 2 and 3) located in the top surface portion 47 of the magazine 48 and extending between adjacent coin channels 50, a coin stop member 64 (FIGS. 2, 3 and 4). Each stop member 64 includes a pair of opposed chamfered edges 66 (FIGs. 2 and 4) which project over the edge of adjacent coin channels 50. Also formed in the top surface of the stop member 64 is a slot 68 which communicates with a second larger slot 70 located in the lower surface of the stop member (FIG. 4). The stop member 64 is assembled on a screw member 72 secured to the coin magazine 48, such screw member 72 extending upwardly through the slots 68 and 70 to a point adjacent the side walls of the slot 68. A pair of spring members 74, 76 located between the screw member 72 and the outer edge of the slot 70 position the stop member 64 normally centrally on the screw member 72. It will be seen from this construction that when a coin 52 is inserted downwardly into the coin channel 50, the edges of the coin will engage the chamfered edges 66 of adjacent stop members 64, thereby camming the stop members away from the coin channel against the action of the springs 74, 76 allowing the coin to be inserted into the coin channel. After the coin has been positioned within the coin channel 50, the springs 74, 76 will again move the stop member 64 to its normal position above the edges of the coins 52 in the coin channel as seen in FIGS. 2 and 4.

As seen in FIG. 3, the coins 52 in each of the coin channel 50 are urged in an upward direction against the under surface of the stop members 64 (FIG. 4) by a pair of piston members 78, 80, each in turn being urged in an upward direction by a pair of spring members 82, one of which is shown in FIG. 3. Two such pistons are used in the present embodiment to prevent over stress of a single spring member 82 of great length which would be required to effectively move the lowermost coins in the coin channel to the top of such channel 50. While the dual piston-spring arrangement shown in FIG. 3 will provide the necessary force to move the lowermost coin in the coin channel to the uppermost position, it is of course obvious that other spring arrangements can be provided to accomplish the same result. One such arrangement could have the piston 78 actuated by a spring member mounted outside the coin magazine 48, extending between the top surface portion 47 of the coin magazine and the piston 78. In such arrangement only one piston would be required. One advantage of the present dual piston-spring construction is that the force required to eject the uppermost coin from the coin channel 50 can remain appropriately constant irrespective of the number of coins 52 in the channel.

As described previously, a novel feature of the invention disclosed herein is the mounting of the coin ejector mechanisms in the cover assembly 32 (FIG. 1). As shown more clearly in FIGS. 2 and 3, secured to the bottom edge of the side wall portions 42, 44 of the cover assembly 32 by means of screws 84 (FIG. 3) or other suitable fastening means is a support plate 86 to which is mounted in any suitable manner a plurality of solenoids 88. As shown in FIG. 2, there is provided a solenoid 88 for each coin channel 50 in the coin magazine 48, each solenoid 88 being orientated on the support plate 86 to overlie the chute 60 located adjacent its associated coin channel 50 when the cover assembly 32 is in a closed position on the housing member 22. Slidably mounted within the solenoid 88 and operated thereby in a manner well known in the art is a plunger 90, the end of which slidably supports in a vertical orientation a shaft 92 positioned within a slot (not shown) located in the outer end of the plunger 90. A compression spring 94 engages the plunger 90 between the solenoid 88 and the shaft 92 and normally urges the plunger 90 leftwardly to its outermost position as viewed in FIG. 3.

Figure 5:
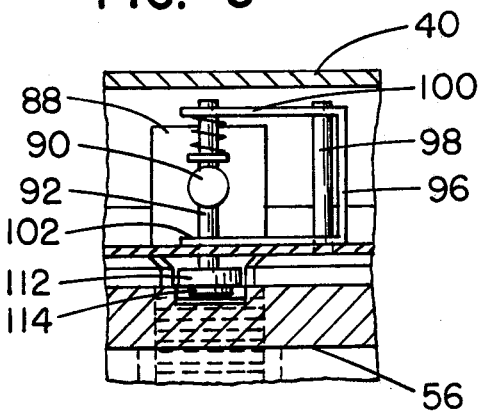
FIG. 5 is a view taken on lines 5—5 of FIG. 2 showing details of the coin ejector yoke member.

Associated with the shaft 92 in a supporting relationship is a U-shaped yoke member 96 (FIGS. 2 and 5) rotatably mounted on a shaft 98 secured to the support plate 86. As clearly shown in FIG. 5, the yoke member 96 includes a pair of laterally extending arm portions 100 and 102, each of which supports the shaft 92 for movement within an arcuate slot 104 (FIGS. 2 and 3) located in the support plate 86. Such slot 104 allows the shaft 92 to follow the movement of the plunger 90 as the plunger is retracted by energizing of the solenoid 88 as will be described more fully hereinafter.

With reference to FIGS. 2–6 inclusive, the present invention further contemplates the provision of means associated with the shaft 92 for ejecting coins 52 from the coin channel 50 to the coin receptacle 36. As seen in FIG. 3, secured to the upper portion of the shaft 92 is a washer member 106 which supports a compression spring 108 mounted on the shaft 92 and which engages the underside of the arm portion 100 of the yoke 96. The action of the spring 108 on the washer member 106 normally urges the shaft 92 in a downward direction. The shaft 92 extends through the slot 104 located in the support plate 86 to a position within the chute 58 located in the top surface portion 47 of the coin magazine 48 when the cover assembly 3 is in closed position on the housing member 22.

Secured to the bottom of the shaft 92 is a second washer member 112 and an ejector member 114. The washer member 112, due to its diameter, extends over a portion of the coins 52 in the coin channel 50. As a result of the action of the compression spring 108, the downward movement of the shaft 92 will move the washer member 112 into engagement with the uppermost coin 52 in the coin channel 50, as shown in FIGS. 2 and 3, against the action of the pistons 78, 80 and springs 82. The coin ejector member 114 may be a washer of suitable diameter or any other shaped abutment member which will be positioned adjacent the uppermost coin 52 in the coin channel in an edge engaging relationship. The action of the spring 108 in moving the shaft 92 and the washer member 112 downwardly into engagement with the uppermost coin in the coin channel 50 insures that the ejector member 114 will be positioned to engage and eject the uppermost coin 52 in the coin channel 50 when actuated.

Figure 6:
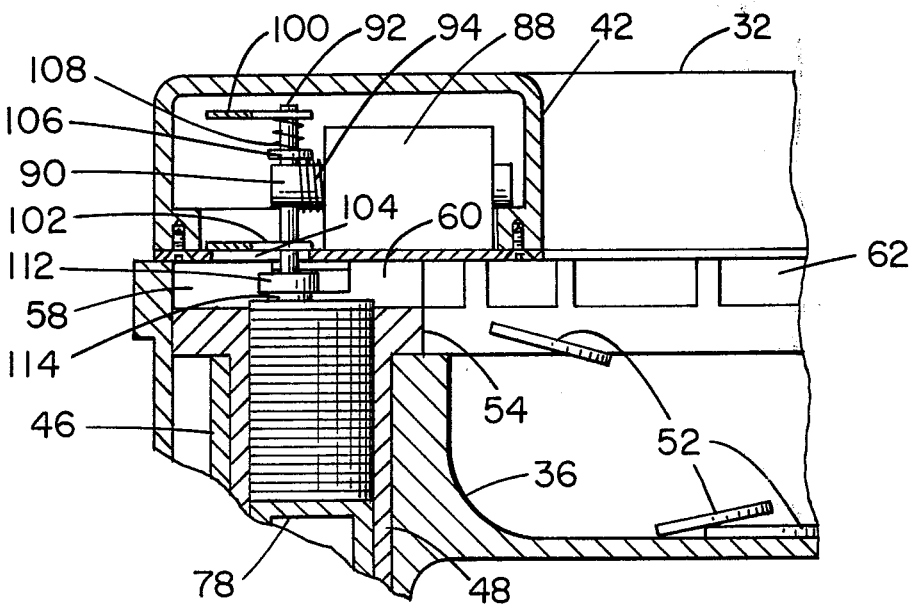
FIG. 6 is a fragmentary view similar to FIG. 3 showing the ejector mechanism in an actuated or coin-ejecting position.

In the operation of the dispensing apparatus 20, energizing a selected solenoid 88 will move its plunger 90 (FIGS. 2 and 3) inwardly against the action of the compression spring 94 (FIG. 6) resulting in the shaft 92 and the ejector member 114 moving likewise inwardly in a coin ejecting direction. This movement of the shaft 92 is supported by the yoke member 96, thus insuring proper alignment of the ejector member 114 with respect to the coins 52 in the coin channel 50 during its coins ejecting movement. The ejector member 114 will kick out the uppermost coin 52 in the coin channel 50 through the chute 60 in the coin magazine and through the opening 62 into the coin receptacle 36 where the coins will be retrieved by the customer (FIG. 6).

The inward movement of the plunger 90 during an ejecting operation will of course compress the spring 94. Upon deenergizing of the solenoid 88, the spring 94 will thus return the plunger 90, the shaft 92 and the ejector member 114 outwardly to their home position as shown in FIG. 3. When this has occurred, the coins 52 in the coin channel 50 will be moved up under the action of the pistons 78 and 80 springs 82 until the uppermost coin engages the under edges of its associate stop members 64. In addition, the washer member 112 will again press down against the uppermost coin in the coin channel 50, thereby locating the ejecting member 114 adjacent the coin for ejection during the next operation of the solenoid 88.

It will be apparent that by mounting the coin ejecting mechanisms in the cover assembly, repair or replacement of all or any part thereof is relatively simple. In addition, the use of the coin stop member 64 in the construction of the coin magazine 48 allows such magazine to be stored in either a horizontal or vertical position without the danger of spilling coins therefrom.

It will further be apparent in light of the foregoing description and drawings that the present invention has provided an improved low cost coin dispenser which may be readily mounted both within and outside a checkout counter installation, and which will position the coin receptacle to allow the customer to conveniently retrieve the change.

While the principles of the invention have been made clear in the illustrated embodiment, it will be obvious to those skilled in the art that many modifications of the structure, arrangements, elements and components can be made which are particularly adapted for specific environments and operating requirements without departing from these principles. The appended claims intend to cover any such modification within the limits only of the true spirit and scope of the invention.

What is claimed is:

1. A change dispensing apparatus comprising:
   a. a coin channel mounted in a generally vertical direction and adapted to receive coins to be dispensed, said coin channel having a top orientated discharge end;
   b. means for moving coins in the coin channel to a coin dispensing position at said discharge end;
   c. a coin retaining means disposing adjacent the discharge end;
   d. means extending in a generally horizontal direction from the discharged end of said coin channel to said coin retaining means to guide coins dispensed from said coin channel to said coin retaining means;
   e. coin delivery means selectively positioned adjacent the top of the discharge end of the coin channel to dispense a coin from said discharge end through said guide means to said coin retaining means when operated;
   f. and means operatively associated with said delivery means to selectively operate said delivery means.

2. The change dispensing apparatus of claim 1 including:
   a. a housing member for supporting the coin channel at a position whereby the discharge end thereof is located adjacent the top of said housing member;
   b. support means positionable on the top of said housing member;
   c. and said delivery means being carried by said support means and positioned adjacent the discharge end of said coin channel upon positioning of the support means on the top of said housing member.

3. The change dispensing apparatus of claim 1 including:
   a. stop means mounted adjacent the discharge end of the coin channel for movement to a coin blocking position with respect to said coin channel;
   b. and means engaging said stop means for normally urging said stop means to said blocking position whereby the uppermost coin in the coin channel will be positioned by said stop means in a dispensing position at said discharge end.

4. The change dispensing apparatus of claim 2 in which said guide means comprises a chute extending transversely across the discharge end of said coin channel and terminating in said coin retaining means, said coin delivery means when operated dispensing the uppermost coin in said coin channel from said discharge end into said chute.

5. The change dispensing apparatus of claim 2 in which said support means is carried by said housing member for movement between a position adjacent and a position away from the top of said housing member, and said delivery means is secured to said support means for positioning adjacent the discharge end of said coin channel upon movement of said support means to its position adjacent the top of said housing member.

6. The coin dispensing apparatus of claim 4 which said coin delivery means extends into a portion of said chute adjacent said coin channel.

7. The change dispensing apparatus of claim 2 in which said support means includes a. a support plate;

b. a cover member secured to and surrounding said support plate;

c. means rotatably mounting said support plate to said housing member for movement between a position adjacent the top of said housing member and a position away from said housing member;

d. said selectively operated means including actuating means secured to said support plate and adapted for movement in a coin ejecting direction when operated;

e. and said coin delivery means includes ejecting means connected with said actuating means, said ejecting means extending to a position engaging the uppermost coin in said coin channel when the support plate is in its housing adjacent position whereby upon operation of said actuating means said ejecting means moving in said coin ejecting direction to eject the uppermost coin from the coin channel into the coin retaining means.

8. The change dispensing apparatus of claim 4 in which said coin retaining means is mounted on top of said housing member adjacent said chute to receive coins dispensed into said chute by operation of said coin dispensing means.

9. The change dispensing apparatus of claim 7 in which said ejecting means includes a. a shaft member secured to said actuating means;

b. and an ejector member secured to said shaft member and positioned for engaging the uppermost coin in the coin channel when the support plate is in said adjacent position to eject said coin from the coin channel upon operation of said actuating means.

10. The change dispensing apparatus of claim 9 including means carried by said support plate for rotatably supporting said shaft member for movement in said coin ejecting direction.

11. The change dispensing apparatus of claim 10 in which said rotatable supporting means includes a. a yoke member rotatably mounted on said support plate, said yoke member supporting said shaft member in a direction perpendicular to the movement thereof by the actuating means in said coin ejecting direction;

b. said apparatus further including a stop member secured to said shaft adjacent the ejection member;

c. and means mounted on said shaft member and engaging said yoke member for urging said shaft member in an axial direction whereby said stop member will engage the uppermost coin in said coin channel and position the ejector member adjacent the edge of said uppermost coin for ejecting said coin upon operation of said actuating means.

12. The change dispensing apparatus of claim 11 in which said stop member comprises a washer of a diameter which extends over the coins in said coin channel whereby upon axial movement of the shaft member in a downward direction said washer will engage and urge the uppermost coin of the coin channel against the action of said moving means to position the ejector member adjacent the edge of said uppermost coin.

13. A change dispensing apparatus comprising in combination:

a. a housing member;

b. a coin receptacle defining a portion of the top surface of said housing member;

c. a coin magazine disposed in said housing member and extending around the edge of the coin receptacle, said coin magazine comprising a plurality of coin channels each having a discharge end positioned adjacent the coin receptacle;

d. means urging coins in each coin channel toward the discharge end thereof;

e. a cover assembly engaging the top of said housing member;

f. a plurality of coin ejecting means mounted in said cover assembly and adapted to engage an uppermost coin in each coin channel for ejecting such coin from said coin channel and into said coin receptacle when operated;

g. and actuating means mounted in said cover assembly for selectively operating each of said coin ejecting means.

14. The change dispensing apparatus of claim 13 in which said cover assembly is rotatably secured to the top of said housing member for movement between an open and closed position engaging said housing member adjacent to the coin receptacle.

15. The change dispensing apparatus of claim 13 including a. a stop member carried by said coin magazine adjacent each coin channel, said stop member in each instance mounted for movement over the discharge end of the coin channel to block the movement of coins in said coin channel from the discharge end thereof;

b. and spring means normally urging the stop member to its coin blocking position, said stop member being moved to a non-blocking position against the action of the spring means upon insertion of a coin within the discharge end of the coin channel whereafter the spring means will return said stop member to its blocking position.

16. The change dispensing apparatus of claim 13 in which said cover assembly includes a. a support member hinged to said housing member for movement between an open position and a closed position engaging the top of the housing member;

b. a cover member secured to said support member, said cover member and said support member adapted to surround the coin receptacle when the support member is in said closed position;

c. said actuating member means is secured to said support member and adapted for movement in an ejecting direction when operated;

d. and each of said ejecting means includes an ejector assembly secured to said actuating members and extending from said support member to a position engaging an uppermost coin in the discharge end of a coin channel when the support member is in a closed position, said ejector assembly moving in an ejecting direction to eject the uppermost coin from the coin channel to the coin receptacle upon operation of said actuating means.

17. The change dispensing apparatus of claim 14 in which said coin magazine includes a chute extending transversely across the discharge end of each of the coin channels and terminating in an opening adjacent the coin receptacle, and said coin ejector means becomes positioned within said chute when the cover assembly is in said closed position for ejecting coins from the coin channel through said opening and to the coin receptacle when operated.

18. The change dispensing apparatus of claim 16 in which the ejector assembly includes a. a shaft member slidably secured to said actuating means;

b. means secured to said support member for rotatably supporting said shaft member for movement in an enjecting direction;

c. and an ejector member secured to the end of said shaft member and engaging the uppermost coin in the coin channel when the support member is in said closed position to eject such coin from the coin channel when moved in an ejecting direction upon operation of said actuating means.

19. The change dispensing apparatus of claim 18 in which said rotatable supporting means includes· a. a yoke member rotatably mounted on said support member, said yoke member slidably supporting said shaft member for movement in a direction perpendicular to the movement of the shaft member in an ejecting direction;

b. a stop member mounted on said shaft member adjacent the ejector member;

c. and a spring member mounted on said shaft member and engaging said yoke member for urging said shaft member in an axial direction whereby said stop member will engage the upper surface of the uppermost coin in said coin channel and position the ejector member adjacent the edge of said coin for ejecting same upon operation of said actuating means.

20. The change dispensing apparatus of claim 19 in which said stop member comprises a washer member of a diameter which extends over the coins in said coin channel and said ejector member comprises a second washer member of a diameter which extends adjacent the edges of the coins in said coin channel.

* * * * *